US008185395B2

(12) United States Patent
Ariyoshi et al.

(10) Patent No.: US 8,185,395 B2
(45) Date of Patent: May 22, 2012

(54) INFORMATION TRANSMISSION DEVICE

(75) Inventors: Tokitomo Ariyoshi, Saitama (JP); Kazuhiro Nakadai, Saitama (JP); Hiroshi Tsujino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 1697 days.

(21) Appl. No.: 11/225,943

(22) Filed: Sep. 13, 2005

(65) Prior Publication Data

US 2006/0069559 A1 Mar. 30, 2006

(30) Foreign Application Priority Data

Sep. 14, 2004 (JP) ..... 2004-267378
Jul. 15, 2005 (JP) ..... 2005-206755

(51) Int. Cl.
*G10L 13/08* (2006.01)

(52) U.S. Cl. ..... 704/260; 704/207; 704/209; 704/244; 704/245; 704/258; 704/268; 704/270; 704/271; 381/56; 700/245

(58) Field of Classification Search ..... 704/268, 704/271, 258, 207, 244, 270, 209, 245, 260; 381/56; 700/245
See application file for complete search history.

(56) References Cited

U.S. PATENT DOCUMENTS 4,590,605 A * 5/1986 Hataoka et al. ..... 704/245
4,783,805 A * 11/1988 Nishio et al. ..... 704/207
5,636,325 A * 6/1997 Farrett ..... 704/258
5,845,047 A * 12/1998 Fukada et al. ..... 704/268
5,860,064 A 1/1999 Henton
5,933,805 A 8/1999 Boss et al.
5,966,690 A * 10/1999 Fujita et al. ..... 704/233
6,151,571 A * 11/2000 Pertrushin ..... 704/209
6,161,091 A * 12/2000 Akamine et al. ..... 704/258
6,182,044 B1 * 1/2001 Fong et al. ..... 704/270
6,442,450 B1 * 8/2002 Inoue et al. ..... 700/245
6,549,887 B1 * 4/2003 Ando et al. ..... 704/271
6,799,162 B1 * 9/2004 Goronzy et al. ..... 704/244
6,836,761 B1 * 12/2004 Kawashima et al. ..... 704/258
6,865,533 B2 * 3/2005 Addison et al. ..... 704/260

(Continued)

FOREIGN PATENT DOCUMENTS

JP 06-139044 5/1994

(Continued)

OTHER PUBLICATIONS

Ariyoshi, T. et al., "Effect of Facial Colors on Humanoids in Emotion Recognition Using Speech," Proceedings of the 2004 IEEE International Workshop on Robot and Human Interactive Communication, Sep. 20-22, 2004, pp. 59-64.
Breazeal, C. et al., "Emotive Qualities in Robot Speech," Proceedings of the 2001 IEEE/RSJ International Conference on Intelligent Robots and Systems, Oct. 29-Nov. 3, 2001, pp. 1388-1394.

(Continued)

*Primary Examiner* — Michael Colucci
(74) *Attorney, Agent, or Firm* — Fenwick & West LLP

(57) ABSTRACT

An information transmission device which analyzes a diction of a speaker and provides an utterance in accordance with the diction of the speaker, and which has a microphone detecting a sound signal of the speaker, a feature extraction unit extracting at least one feature value of the diction of the speaker based on the sound signal detected by the microphone, a voice synthesis unit synthesizing a voice signal to be uttered so that the voice signal has the same feature value as the diction of the speaker, based on the feature value extracted by the feature extraction unit, and a voice output unit performing an utterance based on the voice signal synthesized by the voice synthesis unit.

27 Claims, 11 Drawing Sheets

U.S. PATENT DOCUMENTS

| | | | | |
|---|---|---|---|---|
| 6,963,841 | B2 * | 11/2005 | Handal et al. | 704/270 |
| 2001/0032078 | A1 * | 10/2001 | Fukada | 704/258 |
| 2002/0049594 | A1 * | 4/2002 | Moore et al. | 704/258 |
| 2002/0110248 | A1 * | 8/2002 | Kovales et al. | 381/56 |
| 2002/0133333 | A1 * | 9/2002 | Ito et al. | 704/208 |
| 2002/0184373 | A1 * | 12/2002 | Maes | 709/228 |
| 2003/0093265 | A1 * | 5/2003 | Xu et al. | 704/208 |
| 2003/0182111 | A1 * | 9/2003 | Handal et al. | 704/231 |
| 2004/0148172 | A1 | 7/2004 | Cohen et al. | |

FOREIGN PATENT DOCUMENTS

| | | |
|---|---|---|
| JP | 2001-215993 | 8/2001 |
| JP | 2002-066155 | 3/2002 |
| JP | 2002-264053 | 9/2002 |
| JP | 2003-084800 | 3/2003 |
| JP | 2003-150194 | 5/2003 |
| JP | 2004-061666 | 2/2004 |
| JP | 2004-109323 | 4/2004 |

OTHER PUBLICATIONS

Breazeal, C. et al., "Recognition of Affective Communicative Intent in Robot-Directed Speech," Autonomous Robots, Jan. 2002, pp. 83-104, vol. 12, No. 1.

Eng, K. et al., "Ada: Constructing a Synthetic Organism," Proceedings of the 2002 IEEE/RSJ, Intl. Conference on Intelligent Robots and Systems, EPFL, Sep. 30, 2002, pp. 1808-1813, vol. 1 of 3.

European Search Report, EP 05020010, Dec. 14, 2005, 11 pages.

Iriondo, I. et al., "Validation of an Acoustical Modelling of Emotional Expression in Spanish Using Speech Synthesis Techniques," ISCA Workshop on Speech and Emotion, Sep. 2000, 6 pages.

Sato, J. et al., "Emotion Modeling in Speech Production Using Emotion Space," IEEE International Workshop on Robot and Human Communication, Nov. 1996, pp. 472-477.

Notice of Reasons for Rejection, Japanese Patent Application No. 2005-206755, Apr. 28, 2009, 2 Pages.

* cited by examiner

FIG.8

| PHONEME SEQUENCE | FEATURE OF JOY | FEATURE OF ANGER | FEATURE OF SADNESS | FEATURE OF NEUTRAL |
|---|---|---|---|---|
| SECTION 1 | $d_{1_joy}, f_{dif1_joy}$ SaviolagaMona | $d_{1_anger}, f_{dif1_anger}$ SaviolagaMo | $d_{1_sadness}, f_{dif1_sadness}$ SaviolagaMonaco | $d_{1_neutral}, f_{dif1_neutral}$ SaviolagaMona |
| SECTION 2 | $d_{2_joy}, f_{dif2_joy}$ coekigentsuki | $d_{2_anger}, f_{dif2_anger}$ nocoekigentsuki | $d_{2_sadness}, f_{dif2_sadness}$ ekigentsukinoi | $d_{2_neutral}, f_{dif2_neutral}$ coekigentsuki |
| SECTION 3 | $d_{3_joy}, f_{dif3_joy}$ noisekiwoshita | $d_{3_anger}, f_{dif3_anger}$ noisekiwoshita | $d_{3_sadness}, f_{dif3_sadness}$ sekiwoshita | $d_{3_neutral}, f_{dif3_neutral}$ noisekiwoshita |
| | | | | |

INFORMATION TRANSMISSION DEVICE

BACKGROUND OF THE INVENTION

1. Field of the Invention

The present invention relates to an information transmission device, which is installed on a robot or a computer and performs an information transmission between a person.

2. Description of Relevant Art

Conventionally, a switch or keyboard operation, a voice input/output, and an image display have been used for an information transmission between a person and a machine. These tools are sufficient for transmitting information that can be represented by a symbol or a word, but other types of information has not supposed to be transferred.

On the contrary, the information transmission between a machine and a person should be easy, accurate, and friendly, in preparation for the expected increasing of the contact between a machine and a person in a future. For this purpose, it is important to transfer not only information liken a symbol or a word but other types of information like emotion.

For exchanging information between a machine and a person, means for transmitting information from a person to a machine and means for transmitting information from a machine to a person are required. For expressing an internal state by latter means, the internal state has been expressed by adding prosody to synthetic voice or by providing a quasi face with emotional looking on a machine or by combining these visual and auditory information.

In the case of the machine interface apparatus disclosed in Japanese unexamined patent publication JP H06-139044, for example, an emotional parameter of an agent changes in accordance with a result of a task or with words addressed by a user. Then, a natural language, which was selected based on the emotional parameter, is provided to a user as a voice message. Additionally, the image corresponding to the selected natural language is displayed.

In the case of the invention disclosed in Japanese unexamined patent publication JP2002-66155, a feeling value of a robot changes when words are addressed by a user or the robot is touched by a user. Herewith, the robot utters a reply-sound corresponding to the feeling value and changes the eye color thereof to the color corresponding to the feeling value.

In the case of the invention disclosed in Japanese unexamined patent publication JP2003-84800, a voice message with an emotion is synthesized and is sounded in combination with a light of LED corresponding to the message with an emotion.

Here, for performing a friendly information transfer between a machine and a human, it is important that a machine recognizes an emotion of a person and a person recognizes an internal state of a machine. However, all of the above described inventions are focused on the internal state of the machine, and none of the above described inventions have any consideration of an emotion of others (person). Therefore, an information transmission device which enables the friendly information transmission between a machine and a human has been required.

SUMMARY OF THE INVENTION

The present invention relates to an information transmission device which analyzes a diction of a speaker and provides an utterance in accordance with the diction of the speaker. This information transmission device includes a microphone detecting a sound signal of the speaker, a feature extraction unit extracting at least one feature value of the diction of the speaker based on the sound signal detected by the microphone, a voice synthesis unit synthesizes a voice signal to be uttered so that the voice signal has the same feature value as the diction of the speaker, based on the feature value extracted by the feature extraction unit, and a voice output unit performing an utterance based on the voice signal synthesized by the voice synthesis unit.

According to this information transmission device, a voice signal to be uttered from the voice output unit is modulated by the voice synthesis unit so that the voice signal has the same feature value as the diction of other person (speaker). That is, since the utterance from the information transmission device becomes similar to the utterance of the speaker, the communication as if the device recognizes an emotion of the speaker can be realized.

In the case of a person who speaks slowly, such as an elderly person etc., since the information transmission device utters slowly, an elderly person can catch the utterance easily.

In the case of an impatient person who speaks rapidly, the information transmission device can rapidly utter words by using the utterance speed as a feature value. Thereby, since the diction of the information transmission device can agree with the diction of other person and the tempo of utterance is not interrupted, the intimate communication other than emotional communication can also be performed easily.

The information transmission device of the present invention may include a voice recognition unit, which recognizes a phoneme from the sound signal detected by the microphone by comparison to a sound model of a phoneme memorized beforehand. In this case, the feature extraction unit extracts the feature value based on the phoneme recognized by the voice recognition unit.

In the present invention, furthermore, the feature extraction unit may extract at least one of a sound pressure of the sound signal and a pitch of the sound signal as the feature value. In the present invention, additionally, the feature extraction unit may extract a harmonic structure after the frequency analysis of the sound signal, and may regard the fundamental frequency of the harmonic structure as the pitch, and regard the pitch as the feature value.

In the present invention, still furthermore, the voice synthesis unit has a wave-form template database in which a phoneme and a voice waveform are correlated. In this case, the voice synthesis unit performs a readout of each of the voice waveform corresponding to each phoneme of a phoneme sequence to be uttered, and performs the modulation of the voice waveform based on the feature value to synthesize the sound signal.

In the present invention, additionally, the information transmission device may include an emotion estimation part, which computes at least one feature quantity to be used for the estimation of the emotion from the feature value and estimates the emotion of the speaker based on at least one feature quantity, and a color output part, which indicates a color corresponding to the emotion estimated by the emotion estimation part so that the indication of the color is synchronized with the output of the voice from the voice output unit. In this case, since the color corresponding to the emotion of other person can be indicated, the internal state thereof can be transferred to other person clearly.

For the estimation of the emotion, it is preferable that the emotion estimation part has a first emotion database, in which the relations between at least one feature quantity, a type of the emotion, and a phoneme or a phoneme sequence, are recorded. In this case, the emotion estimation part estimates the emotion by such a way that computing at least one feature quantity for each phoneme or phoneme sequence which were extracted by the voice recognition unit, comparing the computed at least one feature quantities with feature quantities in the first emotion database, finding the closest one, and referring the corresponding emotion.

In the present invention, additionally, the emotion estimation part may have a second emotion database, in which the relation between at least one feature quantity and the type of emotion is recorded. In this case, the emotion of the speaker can be estimated by finding an emotion in the second emotion database which has the closest feature quantity to the computed at least one feature quantity from the feature value.

In the present invention, furthermore, the second emotion database, which stores the correlation between the emotion and at least one feature quantity, may be provided. Here, the correlation is obtained as a result of the learning of a three-layer perception using the computed feature quantity, which is obtained about each emotion from at least one utterance detected by the microphone.

In the present invention, additionally, the information transmission device may include an emotion input part, to which the emotion of the speaker is inputted, e.g. by himself, and a second color output part, which indicates a color corresponding to the emotion inputted through the emotion input part so that the indication of the color is synchronized with the output of the voice from the voice output unit.

According to this information transmission device, an intimate communication can be achieved by changing the color of the apparatus according to the user's operation, depending on a situation.

According to the present invention, since the information transmission device can provide an utterance in compliance with the diction of the speaker, an intimate communication between the device and a person can be achieved.

BRIEF DESCRIPTION OF THE DRAWINGS

FIG. 8 is an explanatory view of the first emotion database.

DETAILED DESCRIPTION OF THE PREFERRED EMBODIMENT

Figure 1:
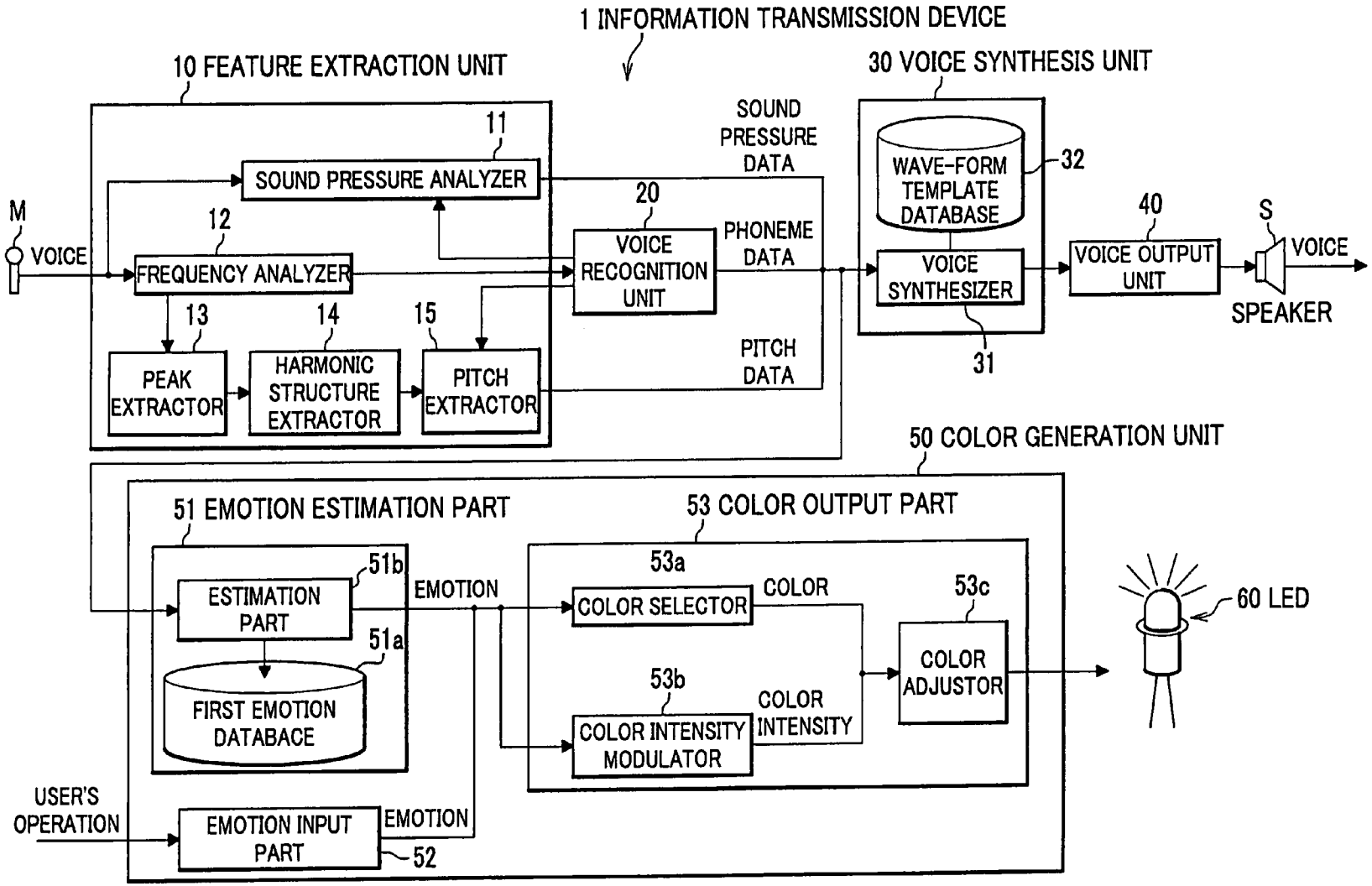
FIG. 1 is a block diagram showing the component of the information transmission device of the present embodiment.

Next, preferred embodiments of the present invention will be explained in detail with reference to the attached drawings. FIG. 1 is a block diagram showing the component of the information transmission device of the present embodiment.

An information transmission device 1 of the present embodiment is an apparatus which analyzes a diction of a person (speaker) and utters words in accordance with the diction of the speaker. Additionally, the information transmission device 1 expresses an internal state thereof by changing the color, e.g. the color of a body, a head etc., at the time of utterance. Here, the internal state of the information transmission device 1 varies in accordance with the diction of the speaker.

The information transmission device 1 is installed on a robot or home electric appliances and has a conversation with a person. Classically, the information transmission device 1 can be represented by using a general-purpose computer having a CPU (Central Processing Unit), a recording unit, an input device including a microphone, and an output device such as speaker. The function of the information transmission device 1 can be realized by running a program stored in the recording unit by CPU.

As shown in FIG. 1, the information transmission device 1 includes a microphone M, a feature extraction unit 10, a voice recognition unit 20, a voice synthesis unit 30, a voice output unit 40, a speaker unit S, a color generation unit 50, and LED 60.

Microphone M

The microphone M is a device for detecting a sound within a surrounding area of the information transmission device 1. The microphone M detects a voice of a person (speaker) as sound signal and supplies sound signal to the feature extraction unit 10.

Feature Extraction Unit 10

The feature extraction unit 10 is a unit for extracting a feature from a voice (sound signal) of a speaker. In this embodiment, the feature extraction unit 10 extracts sound pressure data, pitch data, and phoneme data as a feature value. The feature extraction unit 10 includes a sound pressure analyzer 11, a frequency analyzer 12, a peak extractor 13, a harmonic structure extractor 14, and a pitch extractor 15.

Sound Pressure Analyzer 11

Figure 2:
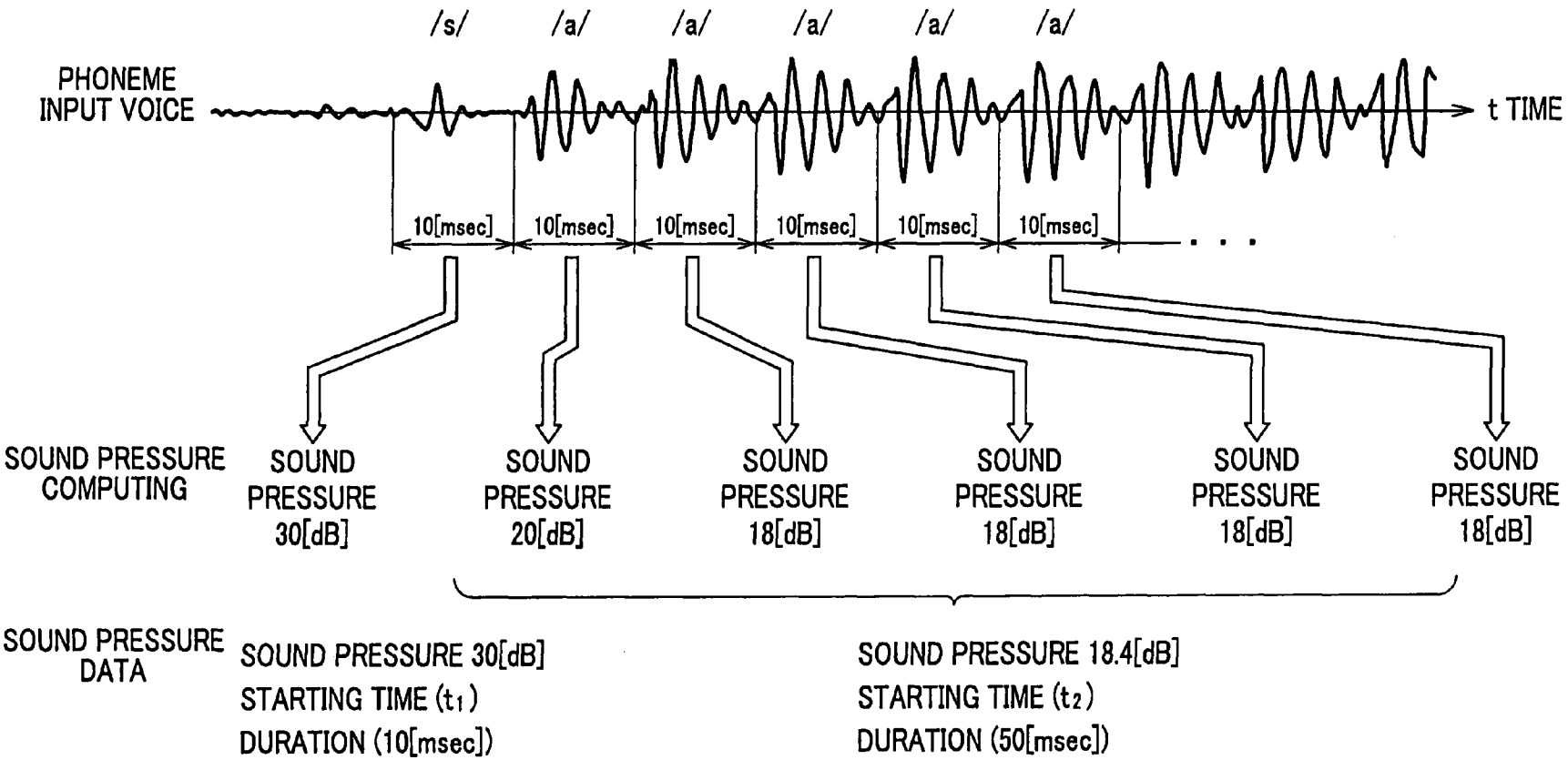
FIG. 2 is an explanatory view of the sound pressure analyzer.

FIG. 2 is an explanatory view of the sound pressure analyzer.

The sound pressure analyzer 11 computes an energy value of sound signal entered from the microphone M at each predetermined shift interval, e.g. 10 [msec]. Then, the sound pressure analyzer 11 calculates an average of energy values of some shifts which correspond to a phoneme duration. Here, duration of the phoneme is acquired from the voice recognition unit 20.

As shown in FIG. 2, for example, if first phoneme of 10 [msec] is /s/ and following phoneme of 50 [msec] is /a/, the sound pressure analyzer 11 computes a sound pressure for each 10 [msec]. In this occasion, if the phoneme of each section of 10 [msec] is in order of 30 [db], 20 [db], 18 [db], 18 [db], 18 [db], and 18 [db], the sound pressure of the first phoneme /s/ of 10 [msec] is 30 [db], and the sound pressure of the subsequent phoneme /a/ of 50 [msec] is 18.4 [db], which is an average of sound pressure of 50 [msec] sections.

The sound pressure data is supplied to the voice synthesis unit 30 and the color generation unit 50 together with a value of the sound pressure, a starting time $t_n$, and a duration.

Frequency Analyzer 12

Figure 3:
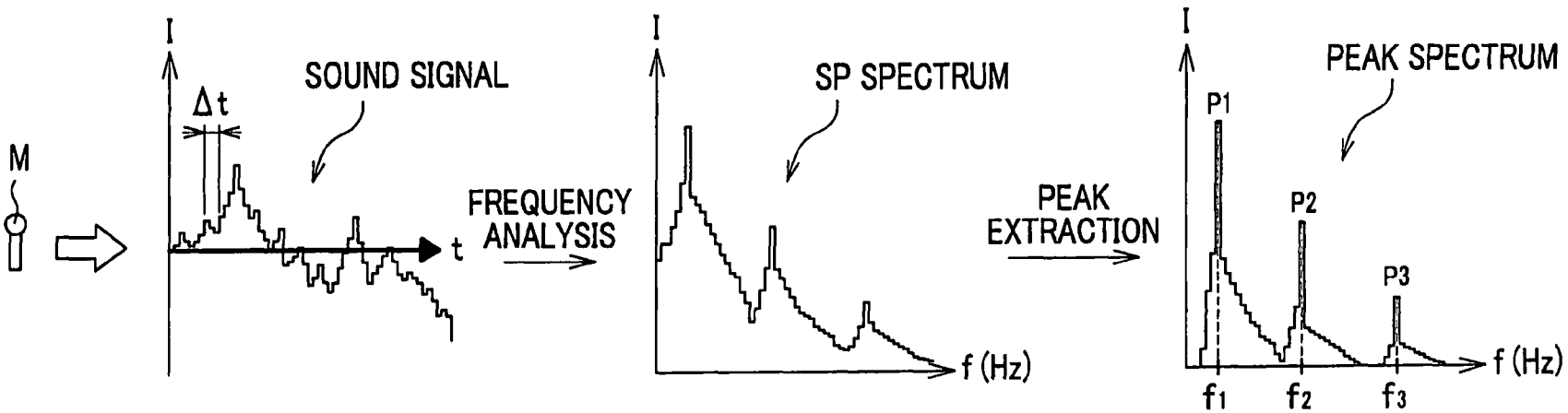
FIG. 3 is a schematic view for explaining from a frequency analysis to an extraction of a harmonic structure.
Figure 4:
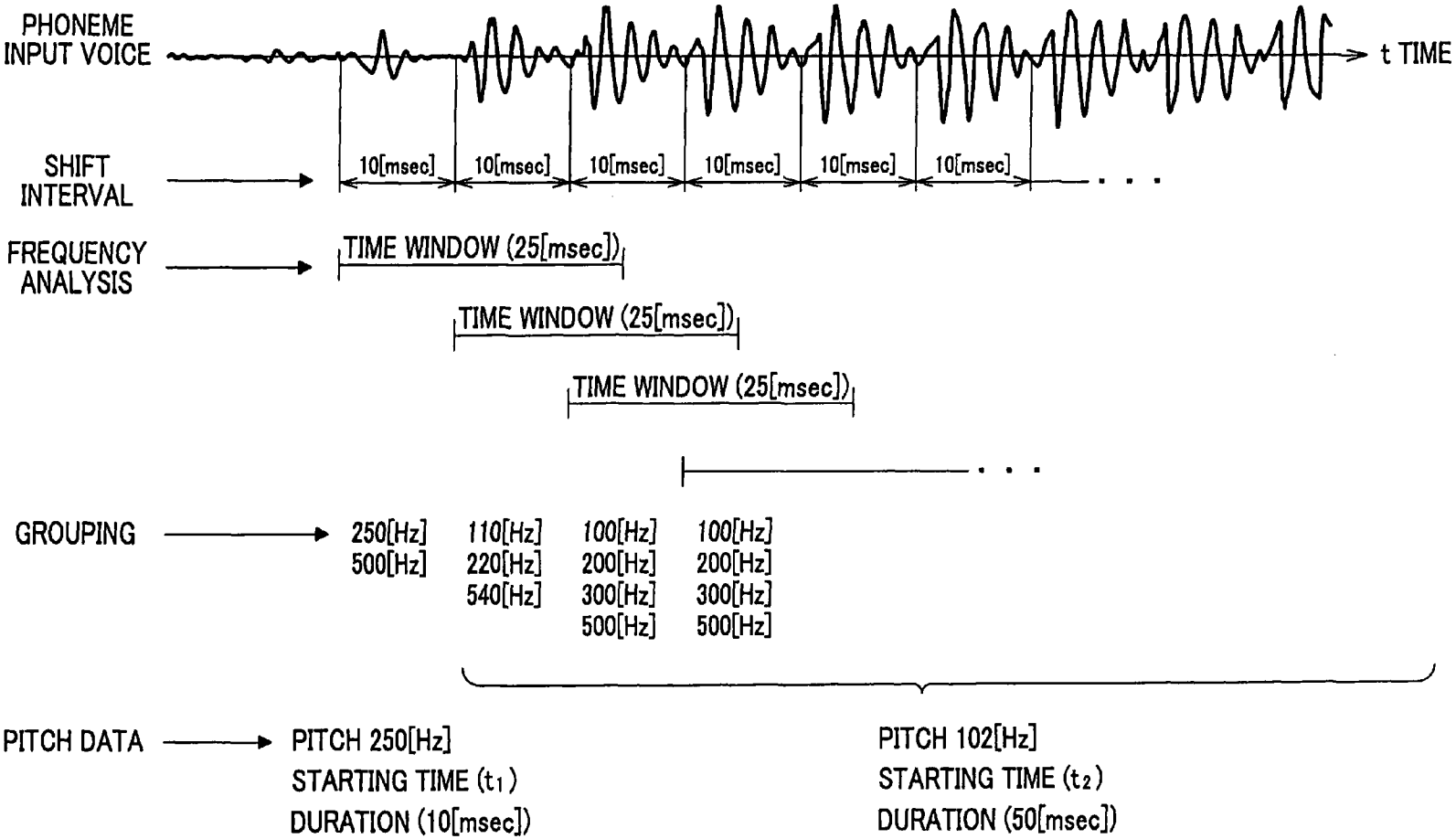
FIG. 4 is an explanatory view explaining the processing to be performed till the extraction of pitch data.

FIG. 3 is a schematic view for explaining from a frequency analysis to an extraction of a harmonic structure. FIG. 4 is an explanatory view explaining the processing to be performed till the extraction of pitch data.

In the frequency analyzer 12, as shown in FIG. 3, signal detected by the microphone M is clipped by time window and analyzed by FFT. The result of the analysis is schematically indicated as spectrum SP. Here, other methods, such as a band-pass filter etc., can be adopted for the frequency analysis.

Peak Extractor 13

The peak extractor 13 extracts a series of peaks from spectrum SP. The extraction of the peak is performed by extracting local peaks of spectrum or by using a spectrum subtraction method (S. F. Boll, A spectral subtraction algorithm for suppression of acoustic noise in speech, Proceedings of 1979 International conference on Acoustics, Speech, and signal Processing (ICASSP-79)).

In the latter method (spectrum subtraction method), firstly, peaks are extracted from spectrum (original spectrum), and then a residual spectrum is generated by subtracting the extracted peaks from original spectrum. The processing of the peak extraction and the generation of the residual spectrum is repeated until no peaks are found in the residual spectrum.

In case of FIG. 3, local peaks P1, P2, and P3 at sub-bands of frequency f1, f2, and f3 are extracted, when the extraction of peaks is performed on spectrum SP.

As shown in FIG. 4, additionally, the harmonic structure (combination of frequencies) changes based on a shift interval, when the extraction (grouping) of the harmonic structure is performed for each shift interval.

In the case of FIG. 4, for example, the frequency of first 10 [msec] is 250 [Hz] and 500 [Hz], and the frequency of each of subsequent 10 [msec] is a harmonics whose fundamental frequency is 100 [Hz] or 110 [Hz]. This difference of the frequency is attributed to the change of a frequency depending on a phoneme and the swing of a pitch that is caused even in the same phoneme during a conversation.

Harmonic Structure Extractor 14

The harmonic structure extractor 14 makes a group of peaks gathering them along with a harmonic structure which sound source have as nature.

A voice of human, for example, includes a harmonic structure, and the harmonic structure is made of a fundamental frequency and its harmonics. Therefore, the grouping of peaks can be performed for each peak in consideration of this rule.

The peaks allocated to the same group based on the harmonic structure can be assumed as the signal from the same sound source. For example, if two speakers are talking simultaneously, two harmonic structures are extracted.

In the case of FIG. 3, f1 corresponds to a fundamental frequency, and f2 and f3 correspond to the harmonics of the fundamental frequency. Thus, each of peak spectrums P1, P2, and P3 belongs to the same group having a one harmonic structure.

Here, if the frequency of the peak obtained by the frequency analysis is 100 [Hz], 200 [Hz], 300 [Hz], 310 [Hz], 500 [Hz], and 780 [Hz], the frequency of 100 [Hz], 200 [Hz], 300 [Hz], and 500 [Hz] are grouped, and the frequency of 310 [Hz] and 780 [Hz] are ignored.

In the case of FIG. 4, first 10 [msec] has the harmonic structure whose fundamental frequency is 250 [Hz], the subsequent 10 [msec] has the harmonic structure whose fundamental frequency is 110 [Hz], and the following 40 [msec] has the harmonic structure whose fundamental frequency is 100 [Hz]. Here, the data relating to the duration of phoneme is acquired from the voice recognition unit 20.

Pitch Extractor 15

The pitch extractor 15 selects, as the pitch of the detected voice, the lowest frequency, i.e. fundamental frequency, of the peak group, which is grouped by the harmonic structure extractor 14. Then, the pitch extractor 15 checks whether or not the pitch is within a predetermined range, that is, the pitch extractor 15 checks whether or not the pitch is within 80 [Hz] and 300 [Hz].

The pitch of the previous time window is adopted instead of the present time window, if the frequency of the peak selected by the pitch extractor 15 is not within this range or if the difference from the pitch of the previous time window exceeds ±50%. If the number of the pitches which corresponds to the duration of phoneme is obtained, an averaging by a duration is performed. Then, the result is supplied to the voice synthesis unit 30 and the color generation unit 50 together with a starting time t and a duration (see FIG. 1 and FIG. 4).

Voice Recognition Unit 20

Figure 5:
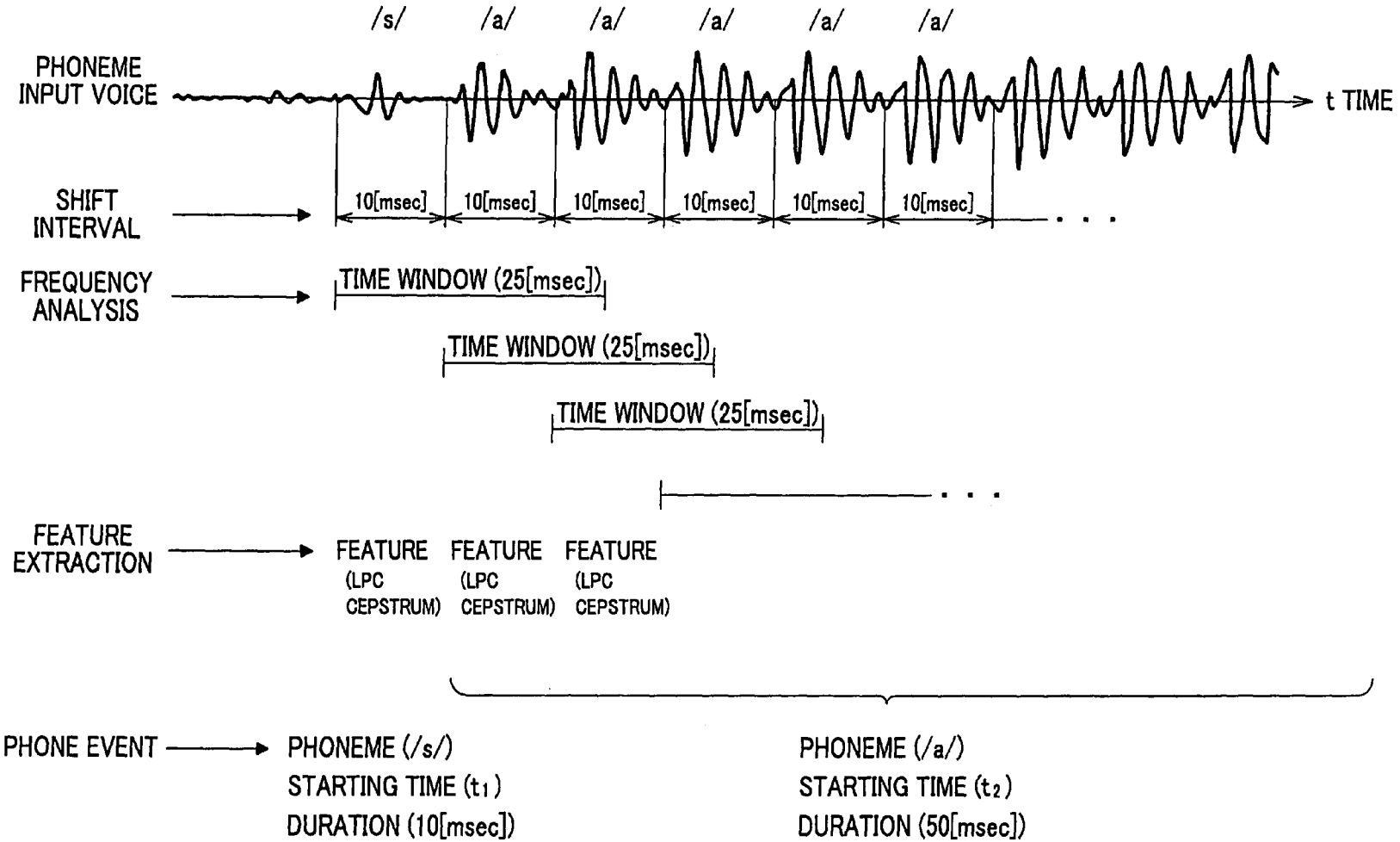
FIG. 5 is an explanatory view explaining the feature extraction by the voice recognition unit.

FIG. 5 is an explanatory view explaining the feature extraction by the voice recognition unit.

The voice recognition unit 20 extracts, for each shift interval, the feature (this is different from "feature value" of the present invention) of the inputted voice based on the spectrum supplied from the frequency analyzer 12. Then, the voice recognition unit 20 recognizes a phoneme of voice by the extracted feature. As the feature of the voice, a liner spectrum, Mel-frequency cepstrum coefficient, and LPC cepstrum are adoptable.

Additionally, the recognition of the phoneme can be performed by HMM (Hidden Markov Model) using the correlation between a sound model and a phoneme stored beforehand.

When the phoneme is extracted, a phoneme sequence, which is the list of the detected phoneme, and a starting time and duration of each phoneme are thus obtained. Here, a starting time is the time the speaker began to speak, and this starting time may be assigned to "0".

Voice Signal Generation Unit 30

The voice synthesis unit 30 includes a voice synthesizer 31 and a wave-form template database 32. This voice synthesis unit 30 generates signal of a voice to be uttered based on sound pressure data, pitch data, phoneme data, and data stored in wave-form template database 32. Here, sound pressure data, pitch data, and phoneme data are feature value to be entered from the feature extraction unit 10. The wave-form template database 32 stores phoneme and voice waveform which are being correlated each other.

Voice Synthesizer 31

The voice synthesizer 31 refers to the wave-form template database 32 based on phoneme data entered from the feature extraction unit 10, and performs a readout of a voice waveform, which serves as a template and corresponds to phoneme data. Here, the voice waveform which serves as a template is referred to as "wave-form template".

Figure 6:
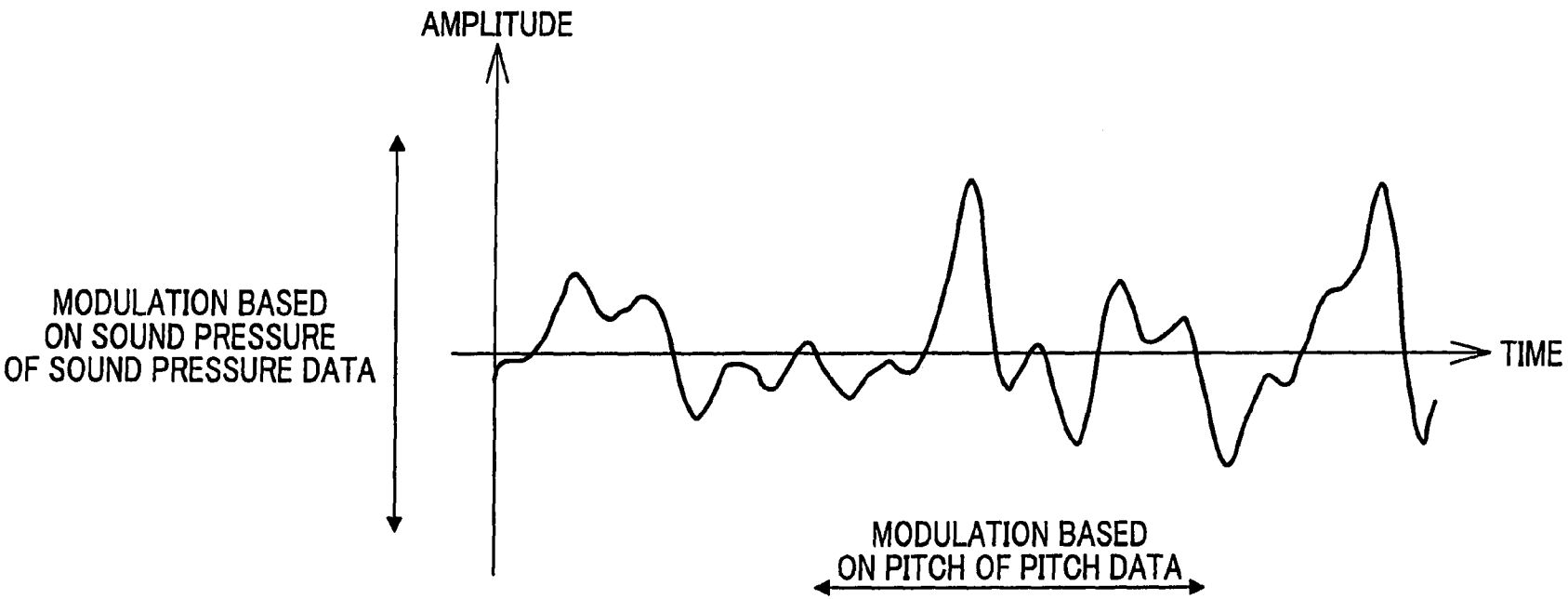
FIG. 6 is an explanatory view showing an example of a wave-form template.

Then, the voice synthesizer 31 modulates the wave-form template in compliance with the sound pressure and pitch when sound pressure data and pitch data are entered from the feature extraction unit 10. For example, when the wave-form template having the shape of FIG. 6 is entered, if an average of sound pressure is 20 [db] and the sound pressure of sound pressure data is 14 [dB], the wave-form template is doubled by 0.5 in the amplitude direction.

If the pitch frequency of pitch data is 120 [Hz] and the pitch of the wave-form template is 100 [Hz], the wave-form template is doubled by $^{100}/_{120}$ in the direction of a time-axis. Then, the wave-form obtained by this modulation is connected so that the length of the connected wave-form becomes the same length as the length of the duration of the phoneme. Thereby, the voice waveform is synthesized, and is entered to the voice output unit 40. After synthesizing the phoneme which has the same length to the duration of the inputted phoneme, next phoneme is inputted and the same process is repeated. When all phonemes are synthesized, they are connected and an obtained wave-form is served to the voice output unit 40.

Voice Output Unit 40

The voice output unit 40 makes the wave-form entered from the voice synthesizer 31 to voice signal, and outputs the voice signal to the speaker unit S. That is, the voice output unit 40 performs the D/A conversion of the voice waveform to obtain voice signal. Then, the voice output unit 40 amplifies the voice signal and transmits the voice signal to the speaker unit S at a suitable timing. In this embodiment, for example, the voice signal may be transmitted three seconds after the termination of the utterance of the speaker.

Complexion Generation Unit 50

As shown in FIG. 1, the color generation unit 50 includes an emotion estimation part 51, an emotion input part 52, and a color output part 53.

Emotion Estimation Part 51

The emotion estimation part 51 estimates the emotion of the speaker based on sound pressure data, pitch data, and phoneme data, which are entered from the feature extraction unit 10, and data stored beforehand within a first emotion database 51*a*.

Figure 7:
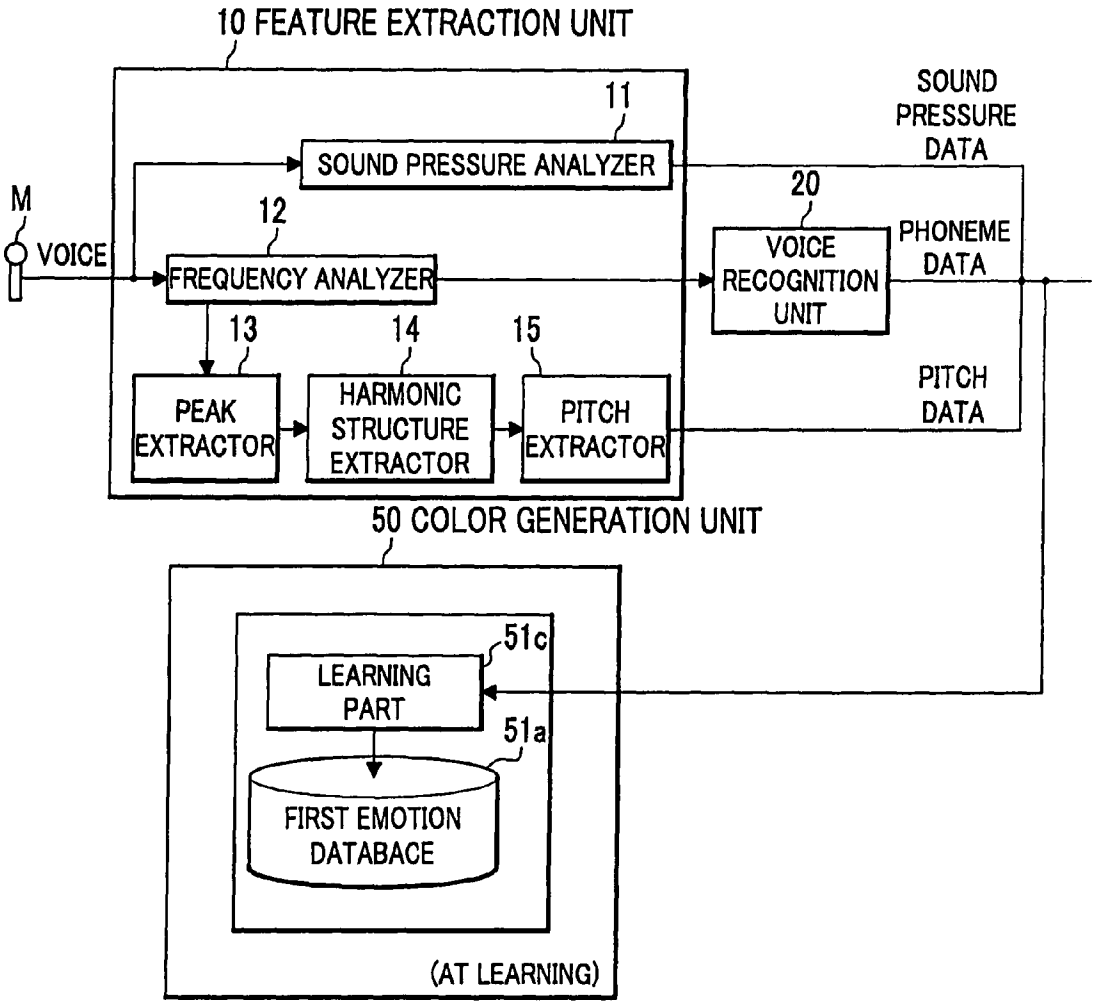
FIG. 7 is a block diagram of the information transmission device that indicates the color generation unit used at the time of a learning.

The first emotion database 51*a* is generated as a result of learning. FIG. 7 is a block diagram of the information transmission device that indicates the color generation unit 50 used at the time of a learning.

As shown in FIG. 7, sound pressure data, phoneme data, and pitch data, which are supplied from the feature extraction unit 10, are inputted to a learning part 51*c*. Then, the learning data generated in the learning part 51*c* is stored in the first emotion database 51*a*.

The learning part 51*c* computes feature quantities, which are used for the estimation of the emotion, from the feature value extracted from the voice, and then generates data (correlation data) to be obtained by correlating a feature quantity with an emotion.

Generally, since a pitch, a duration of a phoneme and a volume (a sound pressure) reflect the emotion of a speaker, the emotion of the speaker can be estimated in consideration of pitch data, phoneme data, and sound pressure data including correlation data.

The generation of the database is performed as following procedures:

(1) leading a person to read some texts, e.g. 1000 texts, with various approaches. For example, utterance of texts with emotions, such as joy, anger, and sadness, or without emotions (a neutral utterance), is performed;

(2) obtaining sound pressure data, pitch data, and phoneme data by the feature extraction unit 10 and the voice recognition unit 20, after detecting a sound of each utterance of texts by the person using the microphone M;

(3) computing some kind of feature quantities (see below) by the learning part 51*c* from each of sound pressure data, pitch data, and phoneme data; and (4) correlating the emotion of each utterance with each of computed feature quantity.

Feature Quantity

The feature quantity to be computed in the above procedure (3) is obtained as follows.

$f_{av}$: an average of pitch frequency (an average of a pitch being included in a predetermined section).

$p_{av}$: an average sound pressure data (an average of a sound pressure being included in a predetermined section).

d: a phoneme density (a value obtained by dividing the number n of a phonemes being included in a predetermined section by the time of the predetermined section).

$f_{dif}$: an average pitch variation rate (a variation rate of pitch frequency in the predetermined section which is obtained based on average value of the pitch frequency of each sub-sections, which are generated by dividing the predetermined section into further three sub-sections. For example, obtaining "$f_{dif}$" as a slope value of a linear function which approximate the relation between time and the average value of pitch).

$p_{dif}$: an average sound pressure variation rate (an variation rate of sound pressure in the predetermined section which is obtained based on average value of the sound pressure data of each subsections, which are generated by dividing the predetermined section into further three sub-sections. For example, obtaining "$p_{dif}$" as a slope value of a linear function which approximate the relation between time and the average value of sound pressure data.

$f_{av}/F_{av}$: a pitch index (the rate to $F_{av}$ of $f_{av}$ of the predetermined section).

$p_{av}/P_{av}$: a sound pressure index (the rate to $P_{av}$ of $p_{av}$ of the predetermined section).

n/N: a phoneme index (the rate to N of n).

Here, $F_{av}$ denotes an average pitch frequency which is an average of whole of the pitch frequencies included in the utterance. $P_{av}$ is an average power which is an average of whole of the sound pressure data in the utterance. N is an average of the number of the phoneme in the utterance.

In the present embodiment, additionally, two types of databases are prepared as the first emotion database 51*a*. One is the database generated based on the utterance of a specific person, and the other is the database generated based on the utterance of non-specific person. Here, the database for non-specific person is generated by averaging the feature quantities which are obtained from the utterance of a plurality of persons The first emotion database 51*a* stores the data which is obtained by correlating an emotion, a phoneme sequence, and each feature quantity. Here, feature quantity is at least one feature quantity among eight feature quantities (see FIG. 8) and is extracted from all utterances, i.e. the utterance for each emotions (happiness, anger, sadness, and neutral) of all texts.

If the content of the text is "Saviola ga Monaco e kigentsuki no iseki wo shita", for example, the utterance of the text is performed about each emotions (happiness, anger, sadness, and neutral). Then, each utterance with each emotion is divided into predetermined sections, e.g. three sections of equal time-length.

In this embodiment, alternatively, predetermined sections may be divided at the inflection point of the in whole utterance or based with same phoneme number. At least one of the eight feature quantities is calculated about each section.

In FIG. 8, the correlation between feature quantities, emotion, and phoneme is indicated about each section. Here, phoneme density d and average pitch variation rate $f_{dif}$ among eight feature quantities are adopted as feature quantity. Also, "joy", "anger", "sadness", and "neutral" are used as the item of the emotion.

The emotion database of present embodiment is not limited to the first emotion database 51*a*. For example, the following second emotion database may be used as the emotion database instead of the first emotion database 51*a*.

In the second emotion database, the data, which is obtained by correlating at least one feature quantity among eight feature quantities with the emotion, is included. Therefore, the data relating to the phoneme is not included.

The data stored in the second database is the data obtained as a result of the learning (statistical learning). Here, the learning is performed as follows; firstly, each feature quantity shown in FIG. 8 is obtained for all texts; and then the obtained feature quantity is categorized based on the types of the emotion, and finally the correlation between the category of the emotion and feature quantity data is learned in order to obtain the data.

For example, if the number of the texts is 100, a total of 100 feature quantities assigned to "joy" are obtained. Thus, the learning of three-layer perception is performed using the obtained feature quantities (here, the input layer is correlated to the number of feature quantities and the middle layer is arbitrary), as the training data. The learning is similarly performed for feature quantities assigned to each group of "joy", "sadness", and "neutral".

Figure 9:
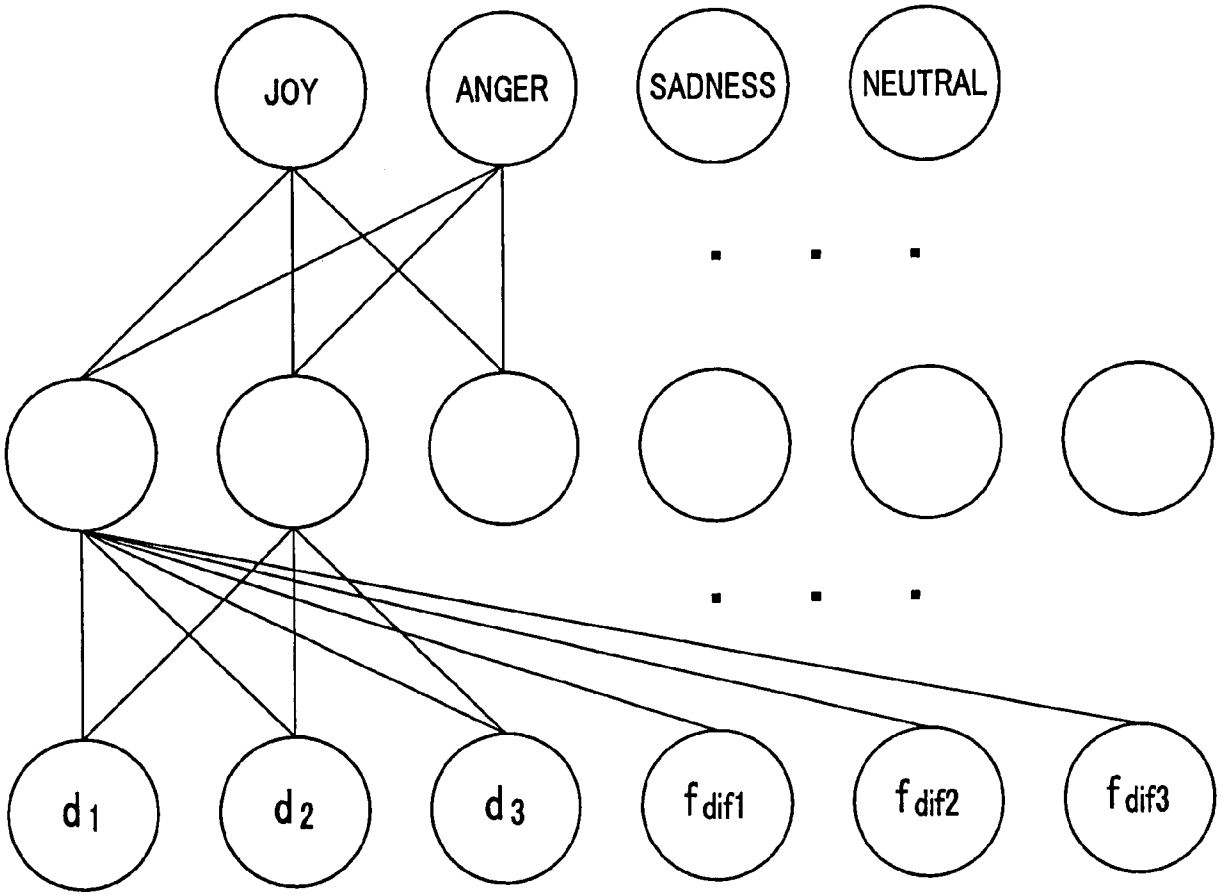
FIG. 9 is a schematic view of a neural network which serves as the second emotion database.

According to this manner, a neural network, in which feature quantities and the emotion are correlated each other, is obtained (see FIG. 9). In this embodiment, other statistic methods like SVM (support vector machine) may be used instead of the neural network.

An estimation part 51*b* divides an inputted voice into three time-sections of equal length as well as the processing at the time of learning, and computes feature quantities applied for the first emotion database 51*a*, from sound pressure data, phoneme data, and pitch data. That is, in the case of FIG. 8, the estimation part 51*b* computes the phoneme density d and the average pitch variation rate $f_{dif}$. Then, the estimation part 51*b* performs the computing for checking which one of "joy", "anger", "sadness", and "neutral" is closest to the computed feature quantity.

This computing is performed by calculating the euclidean distance between feature vectors of inputted voice and a correspondence in the first emotion database 51*a*. In this embodiment, for example, one of vectors is the vector in which the obtained phoneme density d1, d2, and d3, the average pitch variation rate $f_{dif1}$, $f_{dif2}$, and $f_{dif3}$, and phonemes of the inputted voice are adopted as an element of the vector. The other vector is the vector in which each phoneme density $d_{1_joy}$, $d_{2_joy}$, and $d_{3_joy}$, the average variation rate $f_{dif1_joy}$, $f_{dif2_joy}$, and $f_{dif3_joy}$, and phonemes of the correspondence in the first emotion database 51*a* are adopted as an element.

When using the second emotion database, on the contrary, the estimation part 51*b* divides an inputted voice into three predetermined section as well as the processing at the time of learning of the first emotion database 51*a*, and computes the feature quantity applied for the second emotion database, from sound pressure data, phoneme data, and pitch data. That is, the estimation part 51*b* computes the phoneme density $d_1$, $d_2$, and $d_3$ and the average pitch variation rate $f_{dif1}$, $f_{dif2}$, and $f_{dif3}$. Then, the computed feature quantities are processed under a predetermined procedure, which was generated through the learning of the relation between the feature and the emotion, and then the emotion is estimated based on the output result of the predetermined procedure. In this embodiment, for example, neural-network, SVM, or other statistic methods corresponds to this predetermined procedure.

When the estimation of the emotion is performed using the second database, the emotion of the speaker can be estimated without relying on the phoneme. The estimation of the emotion can be enabled even in the case where the speaker utters words or sentences which have been never heard before.

In the case of the words or the sentences which are often spoken, on the other hand, the use of the first emotion database 51*a* which relies on the phoneme provides the increased accuracy of the estimation. Therefore, the flexible and highly accurate estimation of the emotion can be enabled by providing both of the first emotion database 51*a* and second emotion database and switching databases in accordance with the types of the language of the speaker.

Emotion Input Part 52

The emotion input part 52 is used for inputting the emotion by the operation of the user, such as a speaker, and is provided with a mouse, a keyboard, and a specific button for enabling the input of the types (e.g. joy, anger, and sadness) of the emotion.

In this embodiment, the provision of the emotion input part 52 is discretional. The information transmission device may include a device for inputting the strength of the internal state, e.g. the expressed emotion, in addition to the types of the emotion. In this case, for example, the input of the strength of the emotion may be achieved by using the number between 0 to 1.

Color Output Part 53

The color output part 53 (a color output part and a second color output part) expresses the emotion entered from the emotion estimation part 51 or the emotion input part 52, and includes a color selector 53*a*, a color intensity modulator 53*b*, and a color adjustor 53*c*.

The color selector 53*a* selects the color in consideration of the emotion to be entered. The correlation between the emotion and the color is determined based on the investigation in the area of color psychology, e.g. Scheie's color psychology. In this embodiment, for example, the emotion of "joy" is indicated by "yellow", the emotion of "anger" is indicated by "red", and the emotion of "sadness" is indicated by "blue", and the relation between the emotion and the color is determined and stored beforehand. If the emotion to be estimated is "neutral", since it is not required to change the color, the processing with regard to the color is terminated.

The color intensity modulator 53*b* computes the intensity of the color for each phoneme data. That is, the color intensity modulator 53*b* computes intensity of the light. In this embodiment, the intensity of the light is denoted using the number 0 to 1. If the input of phoneme data has been started, i.e. if the utterance has been started, the color intensity modulator 53*b* outputs "1", and if the input of phoneme data has been terminated, i.e. if the utterance has been terminated, the color intensity modulator 53*b* outputs "0". Here, if the intensity of the emotion was inputted by user's operation, the color intensity modulator 53*b* outputs the intensity which was entered by user.

The color adjustor 53*c* adjusts the output to the LED 60 which served as an expression device based on the color entered from the color selector 53*a* and the intensity of color entered from the color intensity modulator 53*b*.

Figure 10A:
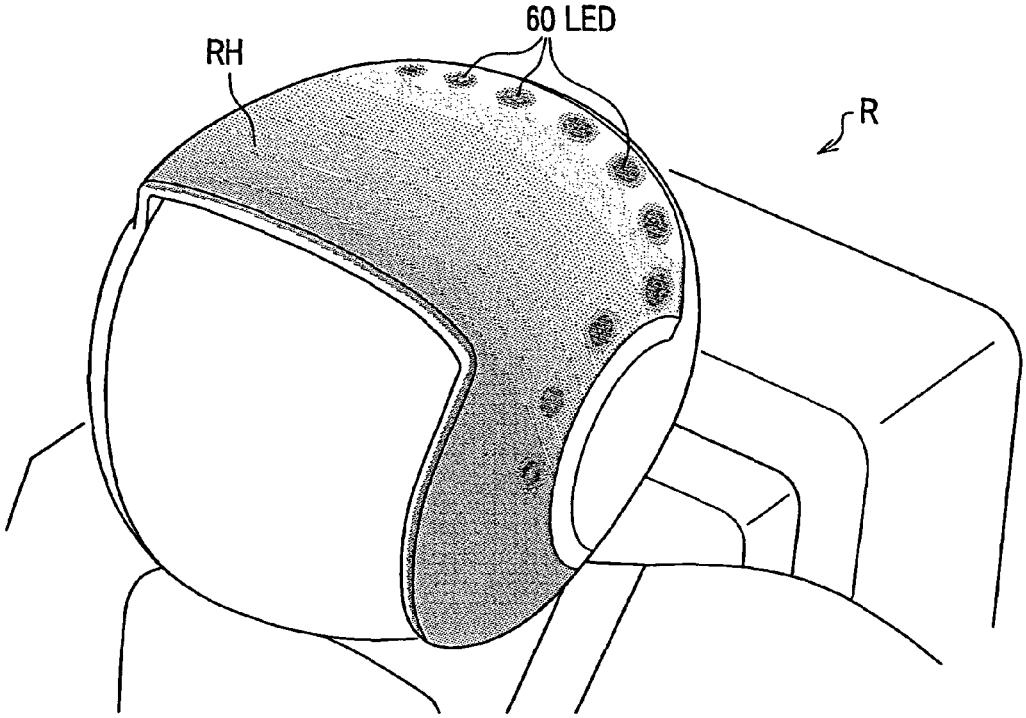
FIG. 10A is an explanatory view showing the state where the head of the robot is shining.

Here, if at least one LED 60 is installed on the head RH of the robot R as shown in FIG. 10A, the color adjustor 53*c*, for indicating the types of the emotion, selects the type of the color (i.e. yellow, red, and blue) of LDEs which are installed on the head RH. Additionally, the color adjustor 53*c* determines the number of LED which is turned on, for adjusting the intensity.

Figure 10B:
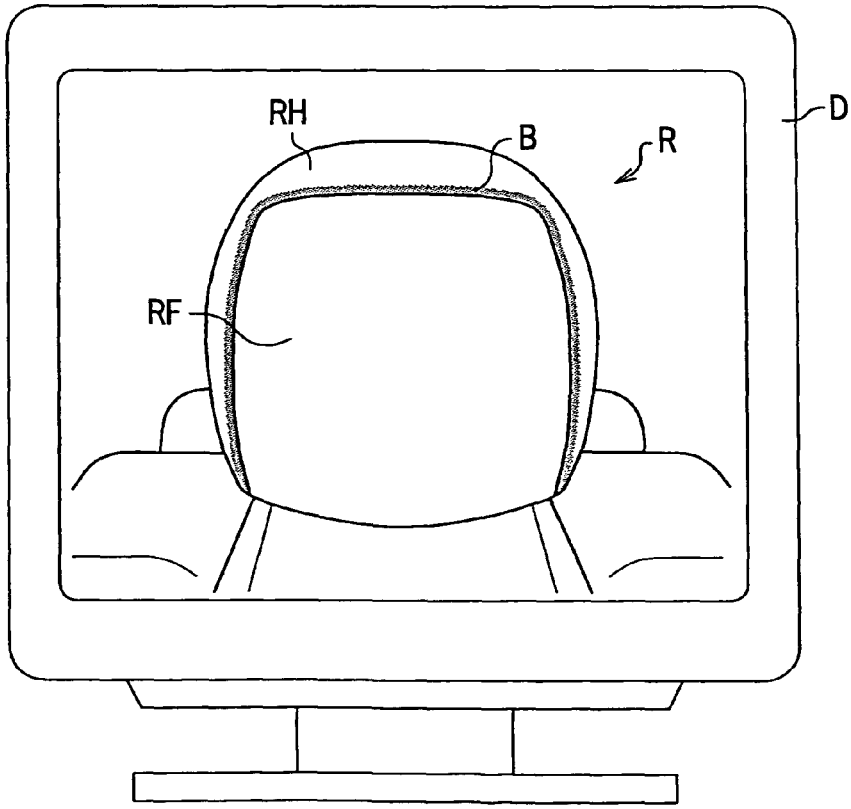
FIG. 10B is an explanatory view showing the indication of the internal state using the robot expressed on the display.

Here, if the information transmission device 1 has a display, the indication of the color may be performed using the display, in which the head Rh of the robot R is expressed therein. In this case, for example, as shown in FIG. 10B, the indication of the color (i.e. yellow, red, and blue) may be performed by using the boundary between the face RF and the head Rh of the robot R as the indication area of the internal state, such as the emotion.

Figure 11:
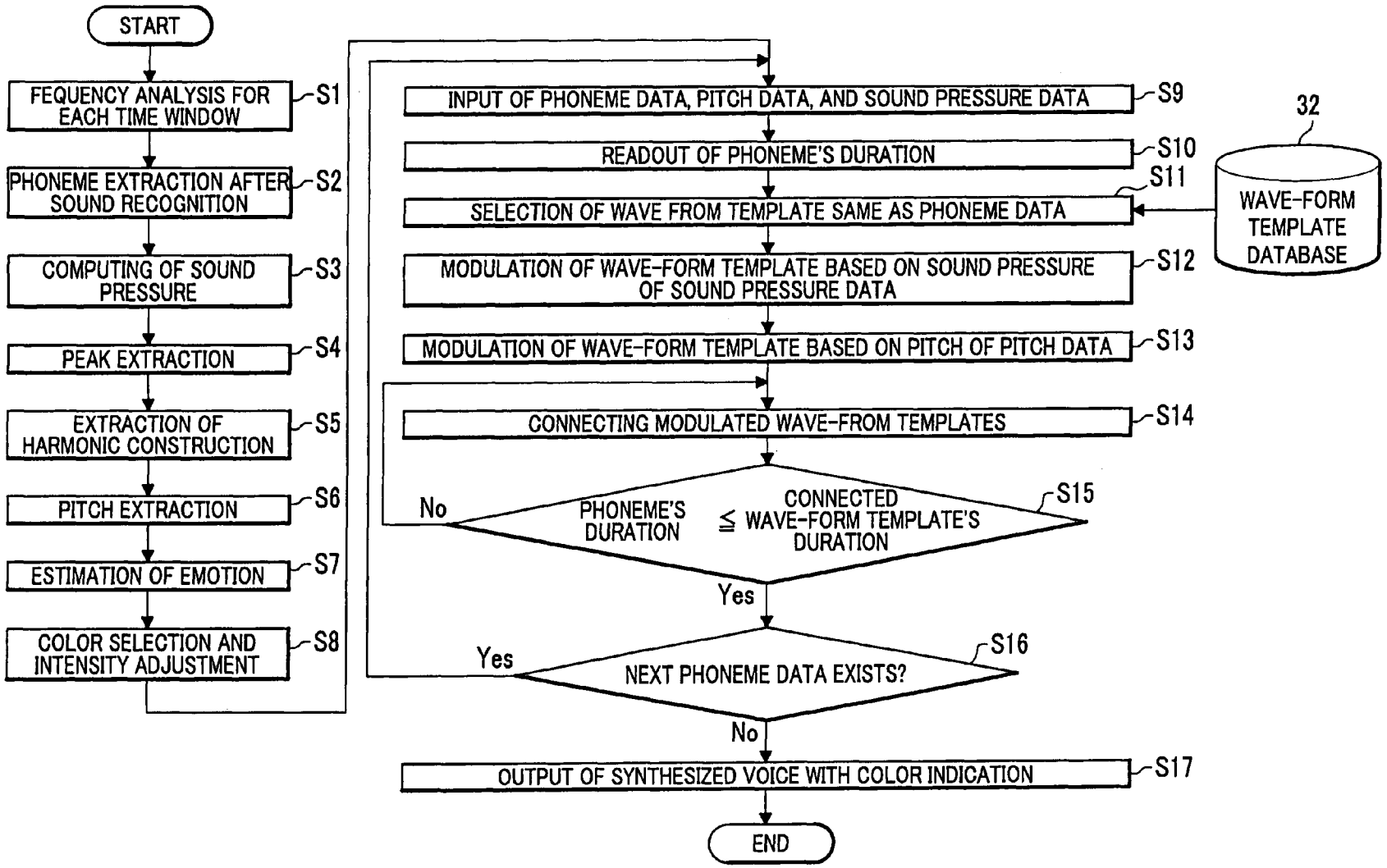
FIG. 11 is a flow chart for explaining the motion of the information transmission device.

Next, the motion of the information transmission device 1 having the above described components will be explained with reference to the flowchart of FIG. 11.

Firstly, a frequency analysis of sound signal detected by the microphone M is performed for each time window of 25 [msec] by the frequency analyzer 12 (S1). Then, the sound recognition is performed by the voice recognition unit 20 based on the relation between the phoneme and the sound model, and then the phoneme is extracted (S2). The phoneme which has been extracted is outputted together with duration to the sound pressure analyzer 11, the pitch extractor 15, and the voice synthesis unit 30.

Next, the sound pressure is computed by the sound pressure analyzer 11 (S3), and sound pressure data is entered to the voice synthesis unit 30 and the color generation unit 50. In this occasion, since the data relating to the duration of the phoneme is entered from the voice recognition unit 20, the sound pressure is computed for each phoneme.

Then, the peak extractor 13 detects, for extracting the pitch, the peak from the result of the frequency analyzer 12 (S4), and extracts the harmonic structure from the frequency arrangement of the detected peak (S5).

Then, the peak which has a lowest frequency among peaks within the harmonic structure is selected, and if the frequency of this peak is within 80 [Hz] to 300 [Hz] this peak is regarded as pitch. If the peak is not within 80 [Hz] to 300 [Hz], other peak which satisfies this requirement is selected as the pitch (S6).

Next, the emotion estimation part 51 of the color generation unit 50 computes the feature quantities ($d_1$, $f_{dif}$) from sound pressure data, phoneme data, and pitch data, and compares them to the feature quantities in the first emotion database 51*a*. Then, the emotion estimation part 51 estimates the emotion by choosing an emotion whose feature quantities are closest to inputted voice's feature quantities (S7).

Next, the color output part 53 selects the color which is proper for the emotion estimated by the color generation unit 50, based on the relation between the color and the emotion, stored beforehand. Then, the color output part 53 adjusts, based on the intensity of the emotion, the intensity (the number of LED 60) of the internal state (light) to be expressed (S8).

On the contrary, the voice synthesis unit 30 generates voice signal in compliance with the diction of the speaker (S9-S16). In other words, the voice synthesis unit 30 generates voice signal having the same feature quantities.

To be more precise, firstly, pitch frequency, phoneme data, and sound pressure data are entered to the voice synthesizer 31 (S9).

Additionally, duration of phoneme is readout (S10). Then, the wave-form template which is the same as the phoneme data is selected with reference to the wave-form template database 32 (S11).

The modulation of the wave-form template is performed in compliance with the sound pressure data and pitch frequency (S12 and S13). By this operation, voice signal to be sounded by the information transmission device 1 agrees with the loudness and pitch of the speaker.

Next, the modulated wave-form template is connected with wave-form templates that have already modulated and connected (S14).

If the duration of the wave-form template that has been connected is shorter than the duration of the phoneme, the connection of the wave-form template is repeated (S14). If not (S15, Yes), it can be regarded that enough waves have been connected for the phoneme. Thus, the processing proceeds to next processing.

Then, if next phoneme data exists (S16, Yes), the processing of steps from S9 to S16 is repeated to generate sound signal of the phoneme. If next phoneme data does not exist (S16, No), the synthesized voice is outputted together with the output (indication) of the color (S17).

According to the information transmission device 1 of the present embodiment, information is transmitted with a voice signal which is synthesized in accordance with the diction of the speaker. That is, since the apparatus adopts the same diction of the speaker, the speaker can sympathize with the apparatus, and information may be transmitted smoothly.

In this embodiment, additionally, the emotion of the speaker is estimated and the color corresponding to the emotion is appeared together with the utterance. This provides the speaker the feeling of as if the apparatus has recognized the emotion of the speaker. Thereby, this enables the intimate communication and will be useful to the dissolution of digital divide.

Although there have been disclosed what are the patent embodiment of the invention, it will be understood by person skilled in the art that variations and modifications may be made thereto without departing from the scope of the invention, which is indicated by the appended claims.

In this embodiment, for example, the utterance is performed by mimicking the feature about the sound pressure and pitch of the speaker. But, an utterance may be performed by mimicking the utterance speed of the speaker.

In this case, for mimicking the utterance speed of the speaker, the utterance speed of the speaker is identified by computing an average of the phonemes in utterance. Then the duration of the phoneme is changed in compliance with the utterance speed. Thereby, the word utterance suitable for the utterance speed of the speaker is enabled.

According to this construction, since the information transmission device 1 utters words slowly when an elderly person utters words slowly to the information transmission device 1, the comprehension of the uttered words becomes easy for an elderly person.

On the contrary, since the information transmission device 1 rapidly utters words when an impatient person rapidly utters words to the information transmission device 1, an impatient person is not irritated. Thus, smooth communication is attained by adjusting the utterance speed in accordance with the speaker.

Typically, the present invention can be easily represented by performing the calculation and analysis based on sound data using the program installed beforehand in a computer, which has a CPU and a recording unit, etc. But, this general-purpose computer is not always required, and the present invention can be represented by using an apparatus equipped with an exclusive circuit.

In the wave-form template database 32, additionally, it is not always required that one wave-form template is correlated with one phoneme. A plurality of wave-form templates may be correlated with the same phoneme. In this case, the voice waveform may be generated by connecting wave-form templates which were selected from among a plurality of wave form templates.

For example, the wave-form template database can store therein a plurality of wave-form templates (e.g. 2500 different species), each of which differs in a pitch, time length, and a sound pressure for each phoneme.

In this case, the voice synthesizer 31 selects the wave-form template, which has an element closest to the phoneme to be uttered, in pitch, sound pressure, and duration, about each phoneme to be uttered. Then, the voice synthesizer 31 generates the voice by connecting wave-form templates after performing a fine-tuning of the pitch, sound pressure, and duration of the wave-form templates.

In this embodiment, additionally, the region where the color is changed in compliance with the emotion of the speaker is not limited to the head. The color of the part of the regions visible from an outside or whole of the regions visible from an outside may be changed instead of the head.

What is claimed is:

1. An information transmission device which analyzes a diction of a speaker of a plurality of speakers and provides an utterance in accordance with the diction of the speaker, the information transmission device comprising:

a microphone detecting a sound signal of the speaker of the plurality of speakers;

a feature extraction unit extracting at least one feature value of the diction of the speaker based on the sound signal detected by the microphone;

a first emotional database for storing a plurality of correlation data of the speaker, the correlation data correlating at least one feature quantity, a type of emotion, and a phoneme or a phoneme sequence based on the detected sound signal of the speaker;

a second emotional database for storing a plurality of correlation data of the plurality of the speakers, the correlation data being generated by averaging the feature quantities computed from the diction of the plurality of the speakers;

an emotion estimation part:

computing at least one feature quantity from the feature value based on the detected sound signal of the speaker;

responsive to the feature quantity being found in the first emotional database:

calculating a distance between at least one computed feature quantity and at least one corresponding feature quantity stored in the first emotional database;

estimating the emotion of the speaker based on the calculated distance and the correlation data stored in the first emotional database; and generating a corresponding emotion indication;

responsive to the feature quantity not being found in the first emotional database;

dividing the detected sound signal of the speaker into a plurality of predetermined sections;

estimating the emotion of the speaker based on the feature quantities in the second emotional database, the feature quantities in the second emotional database being computed from the detected sound signal in the predetermined sections and learning of the first emotional database; and generating a corresponding emotion indication;

a voice synthesis unit synthesizing a voice signal to be uttered so that the voice signal has the same feature value as the diction of the speaker, based on the feature value extracted by the feature extraction unit; and a voice output unit performing an utterance based on the voice signal synthesized by the voice synthesis unit.

2. An information transmission device according to claim 1, further comprising:

a voice recognition unit recognizing a phoneme from the sound signal detected by the microphone by comparison with a sound model of a phoneme memorized beforehand, wherein the feature extraction unit extracts the feature value based on the phoneme recognized by the voice recognition unit.

3. An information transmission device according to claim 1, wherein the feature extraction unit extracts at least one of a sound pressure of the sound signal and a pitch of the sound signal as the feature value.

4. An information transmission device according to claim 1, wherein the feature extraction unit extracts a harmonic structure after the frequency analysis of the sound signal, and regards the fundamental frequency of the harmonic structure as the pitch, and regards the pitch as the feature value.

5. An information transmission device according to claim 2, wherein the voice synthesis unit has a wave-form template database in which a phoneme and a voice waveform are correlated, and the voice synthesis unit performs a readout of each of the voice waveform corresponding to each phoneme of a phoneme sequence to be uttered, and performs the modulation of the voice waveform based on the feature value to synthesize the sound signal so that the length of the correlated voice waveform becomes the same length as the length of the duration of the phoneme.

6. An information transmission device according to claim 2, wherein the feature extraction unit extracts at least one of a sound pressure of the sound signal and a pitch of the sound signal as the feature value.

7. An information transmission device according to claim 2, wherein the feature extraction unit extracts a harmonic structure after the frequency analysis of the sound signal, and regards the fundamental frequency of the harmonic structure as the pitch, and regards the pitch as the feature value.

8. An information transmission device according to claim 1, further comprising:

an emotion input part to which the estimated emotion of the speaker is inputted; and a second color output part indicating a color corresponding to the estimated emotion inputted through the emotion input part so that the indication of the color is synchronized with the output of the voice from the voice output unit.

9. An information transmission device according to claim 6, further comprising:

an emotion input part to which the estimated emotion of the speaker is inputted; and a second color output part indicating a color corresponding to the estimated emotion inputted through the emotion input part so that the indication of the color is synchronized with the output of the voice from the voice output unit.

10. An information transmission device according to claim 7, further comprising:

an emotion input part to which the estimated emotion of the speaker is inputted; and a second color output part indicating a color corresponding to the estimated emotion inputted through the emotion input part so that the indication of the color is synchronized with the output of the voice from the voice output unit.

11. An information transmission device according to claim 1, wherein the emotion database is the first emotion database; and the emotion estimation part estimates the emotion by such a way that computing at least one feature quantity for each phoneme or phoneme sequence which were extracted by the voice recognition unit, comparing the computed at least one feature quantity with feature quantities in the first emotion database, finding the closest one, and referring the corresponding emotion.

12. An information transmission device according to claim 1, wherein the emotion database is the second emotion database in which the relation between at least one feature quantity and the type of the emotion is recorded, and the emotion estimation part estimates the emotion of the speaker by finding an emotion in the second emotion database which has the closest feature quantity to the computed at least one feature quantity from the feature value.

13. An information transmission device according to claim 12, wherein the second emotion database stores the correlation between the emotion and at least one feature quantity, the correlation is obtained as a result of the learning of a three-layer perception using the computed feature quantity, which is obtained about each emotion from at least one utterance detected by the microphone.

14. An information transmission device according to claim 1, wherein the type of emotion is at least one of a group of joy, anger, sadness and neutral.

15. The information transmission device of claim 1, wherein the distance between at least one computed feature quantity and at least one corresponding feature quantity stored in the first emotional database is the Euclidean distance between the computed feature quantity and the corresponding feature quantity stored in the emotional database.

16. The information transmission device of claim 1, wherein estimating the emotion of the speaker based on the calculated distance and the correlation data stored in the first emotional database comprises selecting the type of the emotion in the emotional database being closest to the computed feature quantity.

17. An information transmission device which analyzes a diction of a speaker and provides an utterance in accordance with the diction of the speaker, the information transmission device comprising:

a microphone detecting a sound signal of the speaker;

a feature extraction unit extracting at least one feature value of the diction of the speaker based on the sound signal detected by the microphone;

an emotional database for storing a plurality of correlation data, the correlation data correlating at least one feature quantity, a type of emotion, and a phoneme or a phoneme sequence;

an emotion estimation part:

computing at least one feature quantity from the feature value;

calculating a distance between at least one computed feature quantity and at least one corresponding feature quantity stored in the emotional database; and estimating the emotion of the speaker based on the calculated distance and the correlation data stored in the emotional database;

a voice synthesis unit synthesizing a voice signal to be uttered so that the voice signal has the same feature value as the diction of the speaker, based on the feature value extracted by the feature extraction unit; and a voice output unit performing an utterance based on the voice signal synthesized by the voice synthesis unit; and a color output part:

generating an indication of a color corresponding to the estimated emotion by the emotion estimation part based on correlation between emotion and one of its psychologically related colors; and indicating the color corresponding to the emotion estimated by the emotion estimation part so that the indication of the color is synchronized with the output of the voice from the voice output unit.

18. A computer-readable storage medium with computer executable instructions for controlling a computer processor to perform an information transmission method which analyzes a diction of a speaker of a plurality of speakers and provides an utterance in accordance with the diction of the speaker, the method comprising:

detecting a sound signal of the speaker of the plurality of speakers;

extracting at least one feature value of the diction of the speaker based on the detected sound signal;

storing a plurality of correlation data of the speaker in a first emotional database, the correlation data correlating at least one feature quantity, a type of emotion, and a phoneme or a phoneme sequence based on the detected sound signal of the speaker;

storing a plurality of correlation data of the plurality of the speakers in a second emotional database, the correlation data being generated by averaging the feature quantities computed from the diction of the plurality of the speakers;

computing at least one feature quantity from the feature value based on the detected sound signal of the speaker;

responsive to the feature quantity being found in the first emotional database:

calculating a distance between at least one computed feature quantity and at least one corresponding feature quantity stored in the first emotional database, estimating the emotion of the speaker based on the calculated distance and the correlation data stored in the first emotional database; and generating a corresponding emotion indication;

responsive to the feature quantity not being found in the first emotional database;

dividing the detected sound signal of the speaker into a plurality of predetermined sections;

estimating the emotion of the speaker based on the feature quantities in the second emotional database, the feature quantities in the second emotional database being computed from the detected sound signal in the predetermined sections and learning of the first emotional database; and generating a corresponding emotion indication;

synthesizing a voice signal to be uttered so that the voice signal has the same feature value as the diction of the speaker, based on the extracted feature value; and performing an utterance based on the synthesized voice signal.

19. The method according to claim 18, wherein the emotion indication is a color corresponding to the estimated emotion so that the indication of the color is synchronized with the utterance of the voice.

20. The information transmission method of claim 18, wherein the type of emotion is at least one of a group of joy, anger, sadness and neutral.

21. A computer readable storage medium containing a computer executable program for controlling a computer processor to perform analyzing a diction of a speaker of a plurality of speakers and providing an utterance in accordance with the diction of the speaker, the computer program comprising:

program code for detecting a sound signal of the speaker of the plurality of speakers;

program code for extracting at least one feature value of the diction of the speaker based on the detected sound signal;

program code for storing a plurality of correlation data in a first emotional database, the correlation data correlating at least one feature quantity, a type of emotion, and a phoneme or a phoneme sequence;

program code for storing a plurality of correlation data of the plurality of the speakers in a second emotional database, the correlation data being generated by averaging the feature quantities computed from the diction of the plurality of the speakers;

program code for:

computing at least one feature quantity from the feature value based on the detected sound signal of the speaker;

responsive to the feature quantity being found in the first emotional database:

calculating a distance between at least one computed feature quantity and at least one corresponding feature quantity stored in the first emotional database, estimating the emotion of the speaker based on the calculated distance and the correlation data stored in the first emotional database; and generating a corresponding emotion indication;

responsive to the feature quantity not being found in the first emotional database;

dividing the detected sound signal of the speaker into a plurality of predetermined sections;

estimating the emotion of the speaker based on the feature quantities in the second emotional database, the feature quantities in the second emotional database being computed from the detected sound signal in the predetermined sections and learning of the first emotional database; and generating a corresponding emotion indication;

program code for synthesizing a voice signal to be uttered so that the voice signal has the same feature value as the diction of the speaker, based on the extracted feature value; and program code for performing an utterance based on the synthesized voice signal.

22. The computer program of claim 21, wherein the emotion indication is a color corresponding to the estimated emotion so that the indication of the color is synchronized with the utterance of the voice.

23. The computer program of claim 21, wherein the type of emotion is at least one of a group of joy, anger, sadness and neutral.

24. An information transmission device which analyzes a diction of a speaker of a plurality of speakers and provides an utterance in accordance with the diction of the speaker, the information transmission device comprising:

a microphone detecting a sound signal of the speaker of the plurality of speakers;

a feature extraction unit extracting at least one feature value of the diction of the speaker based on the sound signal detected by the microphone;

a first emotional database for storing a plurality of correlation data of the speakers, the correlation data correlating at least one feature quantity, a type of emotion, and a phoneme or a phoneme sequence based on the detected sound signal of the speaker;

a second emotional database for storing the correlation data of the plurality of the speakers, the correlation data being generated by averaging the feature quantities computed from the diction of the plurality of the speakers;

an emotion estimation part:

selecting an emotional database from the first emotional database and the second emotional database according to the type of the diction of the speaker;

computing at least one feature quantity from the feature value;

applying the computed feature quantity to the selected emotional database;

estimating the emotion of the speaker based on the application of the computed feature quantity to the selected emotional database; and generating a corresponding emotion indication;

a voice synthesis unit synthesizing a voice signal to be uttered so that the voice signal has the same feature value as the diction of the speaker, based on the feature value extracted by the feature extraction unit; and a voice output unit performing an utterance based on the voice signal synthesized by the voice synthesis unit.

25. A computer-readable storage medium with computer executable instructions for controlling a computer processor to perform an information transmission method which analyzes a diction of a speaker and provides an utterance in accordance with the diction of the speaker, the method comprising:

detecting a sound signal of the speaker;

extracting at least one feature value of the diction of the speaker based on the detected sound signal;

storing a plurality of correlation data in an emotional database, the correlation data correlating at least one feature quantity, a type of emotion, and a phoneme or a phoneme sequence;

computing at least one feature quantity from the feature value;

calculating a distance between at least one computed feature quantity and at least one corresponding feature quantity stored in the emotional database, estimating the emotion of the speaker based on the calculated distance and the correlation data stored in the emotional database; and generating an indication of a color corresponding to the estimated emotion based on correlation between emotion and one of its psychologically related colors;

synthesizing a voice signal to be uttered so that the voice signal has the same feature value as the diction of the speaker, based on the extracted feature value;

performing an utterance based on the synthesized voice signal; and outputting the indication of a color corresponding to the estimated emotion so that the indication of the color is synchronized with the utterance based on the synthesized voice signal.

26. A computer readable storage medium containing a computer executable program for controlling a computer processor to perform analyzing a diction of a speaker and providing an utterance in accordance with the diction of the speaker, the computer program comprising:

program code for detecting a sound signal of the speaker;

program code for extracting at least one feature value of the diction of the speaker based on the detected sound signal;

program code for storing a plurality of correlation data in an emotional database, the correlation data correlating at least one feature quantity, a type of emotion, and a phoneme or a phoneme sequence;

program code for:

computing at least one feature quantity from the feature value;

calculating a distance between at least one computed feature quantity and at least one corresponding feature quantity stored in the emotional database, estimating the emotion of the speaker based on the calculated distance and the correlation data stored in the emotional database; and generating an indication of a color corresponding to the estimated emotion based on correlation between emotion and one of its psychologically related colors;

program code for synthesizing a voice signal to be uttered so that the voice signal has the same feature value as the diction of the speaker, based on the extracted feature value;

program code for performing an utterance based on the synthesized voice signal; and program code for outputting the indication of a color corresponding to the estimated emotion so that the indication of the color is synchronized with the utterance based on the synthesized voice signal.

27. An information transmission device which analyzes a diction of a speaker and provides an utterance in accordance with the diction of the speaker, the information transmission device comprising:

a microphone detecting a sound signal of the speaker;

a feature extraction unit extracting at least one feature value of the diction of the speaker based on the sound signal detected by the microphone;

a first emotional database for storing a plurality of correlation data, the correlation data correlating at least one feature quantity, a type of emotion, and a phoneme or a phoneme sequence;

a second emotional database for storing the correlation between a type of emotion and at least one feature quantity;

an emotion estimation part:

selecting an emotional database from the first emotional database and the second emotional database according to the type of the diction of the speaker;

computing at least one feature quantity from the feature value;

applying the computed feature quantity to the selected emotional database; and estimating the emotion of the speaker based on the application of the computed feature quantity to the selected emotional database;

a voice synthesis unit synthesizing a voice signal to be uttered so that the voice signal has the same feature value as the diction of the speaker, based on the feature value extracted by the feature extraction unit;

a voice output unit performing an utterance based on the voice signal synthesized by the voice synthesis unit; and a color selector:

generating an indication of a color corresponding to the estimated emotion based on correlation between emotion and one of its psychologically related colors; and outputting the indication of a color corresponding to the estimated emotion so that the indication of the color is synchronized with the utterance based on the synthesized voice signal.

* * * * *

UNITED STATES PATENT AND TRADEMARK OFFICE

CERTIFICATE OF CORRECTION

PATENT NO. : 8,185,395 B2
APPLICATION NO. : 11/225943
DATED : May 22, 2012
INVENTOR(S) : Tokitomo Ariyoshi et al.

It is certified that error appears in the above-identified patent and that said Letters Patent is hereby corrected as shown below:

Column 15, line 5, delete “perception” and insert --perceptron--.

Signed and Sealed this
Fourteenth Day of August, 2012

David J. Kappos

David J. Kappos
*Director of the United States Patent and Trademark Office*